United States Patent [19]

Ross et al.

[11] Patent Number: 4,995,884

[45] Date of Patent: Feb. 26, 1991

[54] POLYALPHAOLEFIN EMULSIONS FOR FIBER AND TEXTILE APPLICATIONS

[75] Inventors: Stanley E. Ross, Greer; AlexSandra C. Nasser, Mauldin, both of S.C.

[73] Assignee: Henkel Corporation, Ambler, Pa.

[21] Appl. No.: 447,743

[22] Filed: Dec. 8, 1989

[51] Int. Cl.[5] ..... D06M 11/00; D06M 13/00; D06M 13/241; D06M 23/00

[52] U.S. Cl. ..... 8/115.6; 8/127.1; 252/8.6; 252/8.8; 252/8.9

[58] Field of Search ..... 8/115.6, 127.1; 252/8.6, 8.9, 8.8

[56] References Cited

U.S. PATENT DOCUMENTS

| | | | |
|---|---|---|---|
| 3,997,450 | 12/1976 | Steinmiller | 252/8.7 |
| 4,072,617 | 2/1978 | Jahn | 252/8.9 |
| 4,725,371 | 2/1988 | Griffith | 252/8.9 |

*Primary Examiner*—A. Lionel Clingman

*Attorney, Agent, or Firm*—Ernest G. Szoke; Wayne C. Jaeschke; Real J. Grandmaison

[57] ABSTRACT

A process and finish composition for treating fiber and textile material wherein the composition contains from 5 to 20 weight percent of an antistatic agent, from 25 to 50 weight percent of an emulsifier, and the balance, a synthetic hydrocarbon oil.

19 Claims, No Drawings

POLYALPHAOLEFIN EMULSIONS FOR FIBER AND TEXTILE APPLICATIONS

BACKGROUND OF THE INVENTION

1. Field of the Invention

This invention relates to the lubricating and conditioning of textile fibers, and more particularly to a polyalphaolefin emulsion therefor.

2. Discussion of Related Art

Finishing compositions are generally applied fibers to improve the subsequent handling and processing of the fibers. Fiber finishes play a very important role by assisting the fiber producer to manufacture the product, and enabling the fiber producer's customers to carry out the required yarn and fabric manufacturing processes to obtain the end product. The composition and amount of finish composition applied depend in large measure upon the nature, i.e., the chemical composition of the fiber, the particular stage in the processing of the fiber, and the end use under consideration.

For example, compositions referred to as "spin finishes" are usually applied to textile fibers after extrusion. These or other finishes which may be applied to yarn prior to knitting or winding, and to fiber tows prior to or at the time of crimping, drying, cutting, drawing, roving, and spinning, or to staple fibers prior to carding, i.e., web formation, and subsequent textile operations such as yarn manufacture or preparation of nonwoven webs are commonly called secondary or over-finishes. Such finishes provide lubrication, prevent static build-up, and afford a slight cohesion between adjacent fibers.

The application of such finishes is generally accomplished by contacting a fiber tow or yarn with a solution or an emulsion comprising at least one lubricant having antistatic properties. Wetting agents, additives such as antioxidants, biocides, anti-corrosion agents, pH control agents, as well as emulsifiers are also commonly found in such finish mixtures. Finish compositions can also be applied to tow, yarn, or cut staple by spraying.

Acceptable finishes must fulfill a number of requirements in addition to providing desired lubricating and antistatic effects. For example, they should be easy to apply (and to remove if desired), they should have good thermal and chemical stability, they should not adversely affect the physical or chemical properties of the fibers to which they are applied and they should aid the subsequent processes to which the treated fibers are subjected, they should not leave residues on surfaces or cause toxic fumes or undesirable odors, they should provide for rapid wetting of fiber surfaces, they should be water-soluble or emulsifiable or solvent-soluble, they should have good storage stability, they should be compatible with sizes, nonwoven binders and other fiber treatments, they should not attract soil or cause color changes to the fibers, they should not interact with frictional elements used in texturizing and they should not be corrosive to machine parts.

Of the numerous compositions which have been proposed as fiber finishes, some of the more noteworthy may be found in the following prior art. For example, U.S. Pat. No. 4,027,617 discloses a finish for acrylic fiber consisting of an alkyl phenol ethoxylated with 40 to 200 moles of ethylene oxide, an amine salt of hydrogenated tallow alcohol phosphate, and a mixture of mineral oil, an ethoxylated aliphatic monohydric alcohol, and the amine-neutralized reaction product of an ethoxylated aliphatic monohydric alcohol phosphate. In addition, U.S. Pat. No. 3,997,450 relates to a finish composition for synthetic fibers such as polyamides and polyesters, consisting essentially of a lubricant selected from a mono- or diester of an aliphatic carboxylic acid with a monohydric aliphatic alcohol, or a refined mineral, animal or vegetable oil; an emulsifier containing up to 50 moles of alkylene oxide per mole of ester, alcohol, or amide wherein the reactive hydroxyl sites of the emulsifiers contain deactivating and cap groups; and an alkali salt of a dialkyl sulfosuccinic acid. Likewise, U.S. Pat. No. 4,725,371 is directed to a finish for the texturing of partially oriented polyester yarn wherein the composition has a pH of at least 10, and comprises an oil-in-water emulsion wherein the oil phase constitutes 2 to 25 weight percent of the emulsion. The oil phase comprises a lubricant selected from mineral oils, alkyl esters, glycerides, silicone oils, waxes, paraffins, naphthenic and polyolefinic lubricants, glycols, glycol esters, and alkoxylated glycol esters. The emulsifiers employed include soaps, glycerol fatty acid esters, sorbitan and polyoxyethylene sorbitan esters, polyglycerol esters, polyoxyethylene esters or ethers, polyoxyethylene polyol ether esters, polyoxyethylene amines and amides, partial polyol ester ethoxylates, sulfated vegetable oils, sulfonated hydrocarbons, and the like.

However, because of their non-polar nature, polyalphaolefins have traditionally been difficult to emulsify in order to provide aqueous emulsions which possess the stability and other requirements for utility as fiber and textile finishes.

Regardless of the efficacy of the aforementioned and many similar compositions, finishes are often found wanting in certain important aspects, viz., their employment such as in staple fiber processing ordinarily results in one or a combination of the following undesirable conditions: (a) physical properties unacceptable for satisfactory fiber processing under a wide range of conditions; (b) heavy dust and card fallout; (c) substantial deposits on rolls and metal parts of drawing, roving, and spinning equipment, and (d) nonuniformity in the drawing of the sliver, as evidenced by the presence of thick and thin regions therein which are subsequently found in yarn spun therefrom. Further, in processing continuous filament yarns it would be desirable to reduce the fiber to metal friction and provide improved stretching, texturizing, winding and knitting properties thereto.

Accordingly, it is an object of this invention to overcome the aforementioned disadvantages of the prior art and provide the afore-noted desired advantages.

DESCRIPTION OF THE INVENTION

Other than in the operating examples, or where otherwise indicated, all numbers expressing quantities of ingredients or reaction conditions used herein are to be understood as modified in all instances by the term "about."

The foregoing and other related objects are achieved, and the disadvantages of the prior art are obviated, by the provision of a finish composition for fiber and textile applications wherein the composition comprises (1) from 5 to 20 weight percent of an antistatic agent, (2) from 25 to 50 weight percent of an emulsifier, and (3) the balance, a synthetic hydrocarbon oil, all weights being based on the weight of the composition. The composition is applied to textile fibers as an aqueous emulsion containing from 3 to 20 weight percent based on active ingredients.

The antistatic agent may comprise any suitable anionic, cationic, amphoteric or nonionic antistatic agent. Anionic antistatic agents are generally sulfates or phosphates such as the phosphate esters of alcohols or ethoxylated alcohols. Cationic antistatic agents are typified by the quaternary ammonium compounds and imidazolines which possess a positive charge. Examples of nonionics include the polyoxyalkylene derivatives. The anionic and cationic materials tend to be more effective antistats. Preferred anionic antistatic agents for use herein include an alkali metal salt, e.g., potassium, of a phosphate ester such as commercially available from Henkel Corporation, Emery Group, Cincinnati, Ohio, under the tradenames Tryfac 5559 or Tryfac 5576. Preferred cationic antistatic agents include an ethoxylated quaternary amine such as commercially available from Henkel Corporation, Emery Group, Cincinnati, Ohio under the tradename Emerstat 6660.

The amount of antistatic agent present in the finish composition is generally from 10 to 15 weight percent when there is a possibility that static electricity may be a problem. In some cases less might be required, for example, for continuous filament yarns which are interlaced or for a winding operation. In other cases such as for staple fiber processing, larger amounts of antistatic agent may be required. Thus, if a 10% emulsion is used at a wet pickup of 10%, 1% finish will be left on the fiber after the water has evaporated. Of this 1%, 5 to 20% or 0.05 to 0.20% will be the amount of antistatic agent on the fiber.

The emulsifier may comprise any suitable emulsifying agent. Typical emulsifiers include an unethoxylated ester such as sorbitan monolaurate, ethoxylated ester such as ethoxylated sorbitan monooleate, ethoxylated fatty acid such as ethoxylated oleic acid, and ethoxylated alcohol such as ethoxylated $C_{11}$–$C_{15}$ alcohol. An alkali metal soap of a fatty acid such as potassium oleate may be included with an ethoxylate emulsifier, but it is not necessary. Preferred emulsifiers include an ethoxylated sorbitan monooleate (POE(5)) such as commercially available from Henkel Corporation, Emery Group, Cincinnati, Ohio, under the tradename Emsorb 6901; POE (9) oleic acid under the tradename Emery 2646; and a polyethylene glycol ether of secondary alcohol commercially available under the tradename Tergitol® 15-S-3 from Union Carbide Corporation, Danbury, CT.

The synthetic hydrocarbon oil comprises an aliphatic polyalphaolefin containing $C_{20}$–$C_{70}$ dimers, trimers and tetramers of decene-1, such as obtained from the oligomerization of decene-1. The polyalphaolefins selected preferably should also be based upon evaluation of their thermal properties, viscosity behavior, and frictional characteristics, and those which provide stable, translucent aqueous emulsions at a 10 to 15% by weight concentration range after being compounded into a fiber and textile finish composition and diluted with water. Such polyalphaolefins preferably should have a viscosity at about 100° F. of from 18 to 70 centistokes and a SUS value of between 89 and 325; a smoke point of between 330° F. and 430° F.; a flash point of between 437° F. and 514° F.; and a volatility at 200° C. after 30 minutes providing a residual weight of between 45 and 92 percent.

The aforementioned synthetic hydrocarbon oil is available from Henkel Corporation, Emery Group, Cincinnati, Ohio under the tradenames Emery - 3004, Emery - 3006, Emery - 3008 and Emery - 3010. These decene-1 based polyalphaolefins have a gas-liquid chromatography distribution as follows.

| | E-3004 | E-3006 | E-3008 | E-3010 |
|---|---|---|---|---|
| Viscosity @100° F., cSt | 18 | 33 | 48 | 70 |
| GLC, % Dist. | | | | |
| $C_{20}$ | 0.5 | | | |
| $C_{30}$ | 85.9 | 31.5 | 6.4 | 1.6 |
| $C_{40}$ | 13.6 | 45.8 | 44.0 | 36.3 |
| $C_{50}$ | | 17.8 | 34.2 | 35.5 |
| $C_{60}$ | | 4.4 | 11.7 | 13.7 |
| $C_{70}$+ | | 0.9 | 3.7 | 12.9 |
| Mw | 440 | 559 | 649 | 702 |

The synthetic hydrocarbon oil component of this invention is emulsifiable and capable of forming a stable emulsion with water. By the term "stable emulsion" it is meant that the emulsion is stable at the time of application of the emulsion finish to the yarn surface. This is meant to include oil-in-water finishes which may be mixed just prior to their application to the yarn surface and which may be stable only under conditions of mixing and application. Typically, however, the finish will be mixed well prior to yarn application and then applied via various applicators from a storage tank or the like and thus the emulsion must be stable for extended time periods.

The fiber and textile finish composition may be applied to virtually any fiber material including glass, cellulosics such as acetate, triacetate, rayon, non-cellulosics such as acrylics, modacrylic, nylon, aramid, olefins such as polyethylene and polypropylene, polybenzimidazole, polyesters such as polyethylene terephthalate and polybutylene terephthalate or copolyesters thereof, saran, spandex and vinyon.

The finish composition of this invention provides distinct advantages over those of the prior art. For example, compared to a mineral oil-based finish composition, at equivalent viscosities, the instant composition has better thermal properties in that it is less volatile, and whereas mineral oil adversely affects polypropylene by making it swell, the polyalphaolefin-based composition of this invention does not make polypropylene fiber or textile swell. In addition, polyalphaolefins do not contain polynuclear aromatics which are unacceptable from a health standard.

Further, the polyalphaolefin-based composition of this invention is more advantageous than those containing low molecular weight esters such as butyl stearate which, like mineral oils, can cause polypropylene to swell. Further still, esters such as propyl oleate and methyl oleate cause considerable swelling of polyurethanes, for example, polyurethane rolls used on texturizing machines, as evidenced by weight and volume increase of the urethane. The polyalphaolefin-based composition of this invention has no adverse effect: on urethanes.

The present invention will be better understood from the examples which follow, all of which are intended to be illustrative only and not meant to unduly limit the scope of the invention. Unless otherwise indicated, percentages are on a weight-by-weight basis.

EXAMPLE I

A finish composition for fiber and textile applications was prepared having the following formulation.

| Component | %/wt. |
|---|---|
| synthetic hydrocarbon oil(1) | 48.2 |
| POE (5) sorbitan monooleate(2) | 38.6 |
| ethoxylated quaternary amine(3) | 9.7 |
| water | 3.5 |
| | 100.0 |

(1)polyalphaolefin E-3006, available from Henkel Corporation, Emery Group, Cincinnati, Ohio, having a viscosity at 100° F., of 33 centistokes and a SUS of 155, a smoke point of 370° F., and a flash point of 473° F.
(2)ethoxylated sorbitan monooleate, available from Henkel Corporation, Emery Group, Cincinnati, Ohio under the trademane Emsorb 6901.
(3)available from Henkel Corporation, Emery Group, Cincinnati, Ohio, under the tradename Emerstat 6660.

The ingredients listed above and in the following examples, were mixed together at ambient temperature using agitation. In each case the resultant mixture was a clear liquid. Aqueous emulsions were prepared by adding the neat finish composition to water at ambient temperature while agitating the water. The resultant preparation in each case was a fluid, translucent emulsion.

EXAMPLE II

A finish composition for fiber and textile applications was prepared having the following formulation.

| Component | %/wt. |
|---|---|
| synthetic hydrocarbon oil(1) | 49.5 |
| POE (5) sorbitan monooleate(2) | 36.6 |
| phosphate ester, potassium salt(3) | 13.7 |
| water | 0.2 |
| | 100.0 |

(1)polyalphaolefin E-3006 (see Example I).
(2)ethoxylated sorbitan monooleate (see Example I).
(3)available from Henkel Corporation, Emery Group, Cincinnati, Ohio, under the trademane Tryfac 5559.

EXAMPLE III

A finish composition for fiber and textile applications was prepared having the following formulation:

| Component | %/wt. |
|---|---|
| synthetic hydrocarbon oil(1) | 48.2 |
| POE (5) sorbitan monooleate(2) | 38.6 |
| ethoxylated quaternary amine(3) | 9.7 |
| water | 3.5 |
| | 100.0 |

(1)polyalphaolefin E-3004, available from Henkel Corporation, Emery Group, Cincinnati, Ohio, having a viscosity at 100° F., of 18 centistokes and a SUS of 89, a smoke point of 330° F., and a flash point of 437° F.
(2)ethoxylated sorbitan monooleate (see Example I).
(3)available from Henkel Corporation, Emery Group, Cincinnati, Ohio, under the tradename Emerstat 6660.

EXAMPLE IV

A finish composition for fiber and textile applications was prepared having the following formulation:

| Component | %/wt. |
|---|---|
| synthetic hydrocarbon oil(1) | 50.0 |
| POE (5) sorbitan monooleate(2) | 40.0 |
| phosphate ester, potassium salt(3) | 10.0 |
| | 100.0 |

(1)polyalphaolefin E-3004 (see Example III).
(2)ethoxylated sorbitan monooleate (see Example I).
(3)Tryfac 5559 (see Example II).

In following Table 1 are summarized the typical properties of the finish compositions shown in Examples I, II, III and IV.

TABLE 1

| Properties | Ex. I | Ex. II | Ex. III | Ex. IV |
|---|---|---|---|---|
| Activity, %/wt. | 95.5 | 97.3 | 95.5 | 97.5 |
| Appearance | clear, sl. separation after 3 days | clear sl. haze after 5 days | clear | clear |
| Form | pale yellow liq. | almost colorless liq. | pale yellow liq. | almost colorless liq. |
| Ionic character | cationic | anionic | cationic | anionic |
| % moisture | 4.5 | 2.7 | 4.5 | 2.5 |
| Specific gravity, 25° C. | 0.922 | 0.922 | 0.916 | 0.918 |
| Lbs./gal., 25° C. | 7.67 | 7.67 | 7.62 | 7.64 |
| pH, 5% distilled water | 5.5 | 7.2 | 5.3 | 7.1 |
| Viscosity, cs, 100° F. | 148.6 | 155.6 | 117.2 | 120.3 |
| Smoke point, COC, °F. | 285 | 310 | 295 | 310 |
| Flash point, COC, °F. | 350 | 445 | 350 | 400 |
| Volatility, 200° C., 30 min., plus 10 min. reheat, 0.5 g. | | | | |
| (a) % residual wt. | 68.5 | 74.0 | 67.5 | 50.8 |
| (b) appearance | dk. amber liq. | yellow-amber liq. | dk. amber liq. | yellow amber liq. |
| (c) % varnish | 2.8 | 4.1 | 3.5 | 3.7 |
| Volatility, 200° C., 18 hrs., 0.5 g. | | | | |
| (a) % residual wt. | 23.4 | 24.3 | 23.6 | 19.3 |
| (b) appearance | dk. brown solid | dk. brown solid | dk. brown solid | dk. brown solid |
| (c) % varnish | 22.1 | 20.7 | 22.5 | 18.8 |
| Viscosity at 10%/wt. concentration, 25° C., cs. | 2.0 | 2.0 | | |

EXAMPLE V

A finish composition for fiber and textile applications containing a nonionic antistatic agent was prepared having the following formulation.

| Component | %/wt. |
|---|---|
| synthetic hydrocarbon oil(1) | 37.6 |
| sorbitan monolaurate(2) | 32.0 |
| POE (20) sorbitan monolaurate | 24.5 |
| water | 5.9 |
| | 100.0 |

(1)polyalphaolefin E-3006 (see Example I).
(2)available from Henkel Corporation, Emery Group, Cincinnati, Ohio, under the tradename Emsorb 2515.
(3)available from Henkel Corporation, Emery Group, Cincinnati, Ohio, under the tradename Emsorb 6915.

The formulation resulted in a stable emulsion.

EXAMPLES VI-VIII

The following anionic finish compositions illustrate an emulsification system providing a desirable lower viscosity of the neat finish compositions. All amounts are percentages by weight.

| Component | Ex. VI | Ex. VII | Ex. VIII |
|---|---|---|---|
| synthetic hydrocarbon oil | 50.0(1) | 56.6(2) | 56.6(3) |
| Tergitol ® 15-S-3 | 7.3 | 7.3 | 7.3 |
| Emery 2646 | 14.5 | 14.5 | 14.5 |
| Tryfac 5576 | 7.3 | 7.3 | 7.3 |
| Emery 221 (oleic acid) | 9.6 | 9.6 | 9.6 |
| 45%/wt KOH | 0.3 | 0.3 | 0.3 |
| Water | 11.0 | 4.4 | 4.4 |
| | 100.0 | 100.0 | 100.0 |

(1)polyalphaolefin E-3004 (see Example III)
(2)polyalphaolefin E-3008, available from Henkel Corporation, Emery Group, Cincinnati, Ohio having a viscosity at 100° F. of 48 centistokes and a SUS of 223, a smoke point of 410° F., and a flash point of 514° F.
(3)polyalphaolefin E-3006 (see Example I).

In the following Table 2 are summarized the typical properties of the finish compositions shown in Examples VI, VII and VIII.

TABLE 2

| Properties | Example VI | Example VII | Example VIII |
|---|---|---|---|
| Activity, %/wt. | 88 | 94 | 94 |
| Appearance | Clear, pale yellow liq. | Clear, pale yellow liq. | Clear, pale yellow liq. |
| Ionic Character | Anionic | Anionic | Anionic |
| Moisture, % | 12 | 6 | 6 |
| Sp. Gr., 25° C. | 0.896 | 0.895 | 0.889 |
| Density, lb/gal., 25° C. | 7.45 | 7.45 | 7.40 |
| pH, 5% distilled water | 6.9 | 6.9 | 6.9 |
| Viscosity, 100° F., cs | 48 | 69 | 53 |
| Thermal Properties | | | |
| Smoke Pt, °F., (C.O.C.) | N/A | N/A | N/A |
| Flash Pt, °F., (C.O.C.) | N/A | 395 | 420 |
| Residual Wt, % | | | |
| 200° C., 30 min, 0.5 g | 37.2 | 70.4 | 60.7 |
| 200° C., 18 hrs, 0.5 g | 9.1 | 22.6 | 15.6 |
| Varnish, % | | | |
| 200° C., 30 min, 0.5 g | 1.6 | 4.7 | 2.3 |
| 200° C., 18 hrs, 0.5 g | 6.4 | 11.6 | 8.6 |

The finish compositions disclosed in the foregoing examples are eminently suitable for fiber and textile applications due to their overall properties. For example, in the melt spinning process used for polypropylene manufacture, the polymer is melted and extruded through spinnerette holes into filaments which are cooled and solidified int he air stream or water bath. Shortly after, they contact a finish composition applicator which can be in the form of a kiss roll rotating in a through. The amount of finish composition applied to the filaments can be controlled by the concentration of finish composition in the solution or emulsion and the total wet pick-up. Alternately, positive metering systems may be used which pump the finish composition to a ceramic slot which allows the finish composition to contact the moving filaments.

From this point, the yarn which now has a coating of finish composition moves forward into any of several processes. If staple fiber is the desired product, the filament bundles are combined into large tows, oriented by stretching, crimped, and cut into short lengths for processing on textile equipment to ultimately make yarn or nonwoven webs. If continuous filament yarn is the desired product, the filaments are also oriented but as discrete bundles containing a specific number of filaments and are wound as long continuous lengths. There are several versions of this process.

In one version the unoriented or undrawn yarn is wound on a package, and drawn on a drawtwister. In another version called spin draw, the drawing operation is carried out in a continuous fashion on the same equipment without the step of winding the undrawn yarn.

Texturized yarns are also made as continuous filament yarns. Again, texturized yarns can be made by texturizing a fully oriented yarn or by simultaneously orienting and texturizing a partially oriented yarn.

In some of these processes the original spin finish composition application carries the fibers through the entire process. In others, supplementary or overfinishes are applied somewhere later in the process.

FINISH COMPOSITION EVALUATIONS

As earlier indicated herein, frictional, antistatic, thermal, and wetting properties of the finish composition are crucial with regard to fiber performance.

Frictional properties can be readily measured by applying known amounts of finish composition to yarns under controlled conditions in the laboratory. Recognizing that laboratory measurements at best only simulate actual use conditions, they have nevertheless been found to be a reasonably good predictor of behavior. One of the well-known instruments for performing frictional measurements is the Rothschild F Meter. In case of fiber to metal friction, the measurement is carried out by pulling a yarn around a circular metal pin under conditions of known pre-tension and angle of contact. The output tension is measured and the coefficient of friction determined from the capstan equation $$T_2/T_1 = e\mu\Theta$$

where $T_1$ and $T_2$ are the incoming and outgoing tensions respectively, $\Theta$ the angle of contact in radians, and $\mu$ the coefficient of friction. The Rothschild instrument calculates and plots the coefficient of friction automatically. Some prefer to use the value of $T_2 - T_1$ as a measure of the frictional force since strictly speaking the capstan equation is not accurately obeyed by compressible materials such as fibers.

There are a number of variables, both mechanical and physical, in addition to the pretension and angle of contact, which can influence friction results. Some of these are speed, surface roughness, surface temperature, ambient temperature and humidity, finish composition viscosity, uniformity of finish composition application, finish composition concentration on the fiber, and fiber size and shape. Thus, when performing laboratory frictional experiments to determine the performance of a finish composition, one should select a condition related to that which the yarn will be exposed, such as for example, frictional measurements against a heated surface.

The fiber to fiber friction measurement is carried out in a similar way except that the yarn is twisted around itself and the force determined to pull the yarn in contact with itself. Again, with a knowledge of the incoming tension, the angle of wrap, and the outgoing tension, the frictional coefficient can be determined. In the case of fiber to fiber friction, it is customary to distinguish between static and dynamic frictional coefficients. Static friction is determined at a low speed (on the order of 1 cm/min), and dynamic friction at a higher speed. When measuring low speed friction, a stick-slip phenomenon is sometimes observed. It is this measurement which is most closely related to the "scroop" observed with staple fibers, or the cohesion of staple fiber web as it emerges from a card, or the performance of a finish composition in yielding a yarn package which is stable and does not slough. The stick-slip phenomenon indicates that the static friction is higher than the dynamic friction and can be affected by the behavior of boundary lubricants.

Antistats function by either reducing the charge generation or by increasing the rate of charge dissipation. Most antistats operate by increasing the rate of dissipation and rely on atmospheric moisture for their effectiveness. A hydrophobic fiber such as polypropylene depends on an antistat coating to impart high surface conductivity for charge dissipation. There are several ways to assess the antistatic activity of a finish composition. During the measurement of fiber to metal friction and the passage of yarn around the metal pin, static charges are generated. The Rothschild friction meter has an electrostatic voltmeter attachment which measures the charge generated by the moving yarn. At periodic intervals, the static is discharged and allowed to rebuild. Correlation of the charge developed in this measurement with actual performance observed under various manufacturing and use conditions is generally very good provided the relative humidity is reasonably close to the test condition.

Another method for assessing the antistatic activity of a finish composition is to measure the time for a charge to dissipate after the fiber has been charged. This is called the half-life measurement, but it is not conducted on a moving yarn. Still another technique is to measure the resistivity of a nonmoving yarn using an ohm-meter capable of measuring high resistance. Theoretically, the higher the resistance, the lower the conductivity and the poorer the antistat.

The effect of aging on antistat performance can also be determined by any of these methods. Migration of the antistat from the fiber surface to the interior can occur under certain conditions with a subsequent loss of surface antistatic activity.

The effect of frictional and static properties is generally obvious throughout fiber manufacture and processing. Fiber to fiber friction is important to the fiber producer in controlling formation and stability of filament yarn packages since sloughing can occur if it is too low. Also, if fiber to fiber friction is too low, there could be problems of poor web cohesion in carding of staple fibers. On the other hand, low fiber to fiber friction is very desirable for continuous filament yarns which are used in applications such as cordage which involves twisting and plying. Low friction is desirable since it is associated with high flex resistance and high energy absorption and therefore, long life. Fiber to metal friction is also very important in many of the fiber processes. Lower fiber to metal friction is generally preferred since there is less opportunity for damage to the fibers either by abrasion or heat generation as the yarn contacts metal surfaces.

Thermal behavior of finish compositions or components thereof is another major criterion used in their evaluation. There are several aspects to this consideration; volatility and residue formation. Some of the manufacturing processes involve contact of the fibers with heated surfaces. The surface can be in the form of heated rolls, heated plates, or crimper or texturizing chambers. Some finish compositions or their components tend to volatilize and fume when in contact with the heated surface. Further, deposition of the finish composition on heated surfaces can occur and on prolonged heating, residues which are insoluble or difficult to remove can be formed as a result of thermal decomposition. These residues are undesirable since they can interfere with the process.

There are several techniques to assess these thermal properties of a finish composition. Thermogravimetric analysis (TGA) is one of these and has proven to be a useful tool in characterizing weight loss - temperature behavior. Examination of TGA data indicates how the finish composition components rate with regard to volatility and decomposition and which are, therefore, most compatible with the temperature requirements of the system. This information together with smoke point determination and volatility measurements obtained by determining weight loss as a function of time at a given temperature (isothermal analysis) will generally give a reasonably complete picture of the thermal properties of the finish composition.

Residues which remain on heated surfaces can be a major source of problems by impeding the path of the yarn and by requiring more frequent cleaning cycles. One of the methods for determining this property is to place several grams of the finish composition in a dish and to heat the dish to temperatures on the order of 150°-200° C. for a period of 16 hours or longer as described in the volatility test. The residue is weighed and examined for general appearance, solubility, and ease or difficulty in removal from the dish. With the more volatile materials, the ideal behavior is to leave no residue at all. With the less volatile materials, the preference is to find the finish composition intact or at least not in the form of a hard to remove varnish.

In order to obtain optimum performance of the finish composition, it is essential that the finish composition wet the fiber surface uniformly. This requires the finish composition to have a lower surface tension than the fiber, and the surface tension can be measured by one of several available surface tensiometers. If the surface tension of the liquid is too high, it will not uniformly coat the fiber surface. This uniform coating is important not only for frictional uniformity but also for charge leakage to eliminate static. Therefore, it is important that this property also be considered when evaluating the performance of a finish composition.

What is claimed is:

1. A finish composition for fiber and textile materials comprising from about 5 to about 20 weight percent of antistatic agent, from about 25 to about 50 weight percent of an emulsifier, and the balance, a synthetic hydrocarbon oil comprising of an aliphatic polyalphaolefin obtained from the oligomerization of decene−1, based on the weight of said composition.

2. A finish composition as in claim 1 wherein said antistatic agent comprises an alkali metal salt of a phosphate ester.

3. A finish composition as in claim 2 wherein said antistatic agent comprises a potassium salt of a phosphate ester.

4. A finish composition as in claim 1 wherein said antistatic agent comprises an ethoxylated quaternary amine.

5. A finish composition as in claim 1 wherein said antistatic agent is present in said composition in an amount of from about 10 to 15 weight percent.

6. A finish composition as in claim 1 wherein said emulsifier is selected from the group consisting of an ester, ethoxylated ester, ethoxylated fatty acid, and ethoxylated alcohol.

7. A finish composition as in claim 1 containing an alkali metal soap of a fatty acid.

8. A finish composition as in claim 1 wherein said polyalphaolefin contains dimers, trimers and tetramers of decene-1.

9. A finish composition as in claim 8 wherein said polyalphaolefin has a viscosity at about 100° F. of from about 18 to about 70 centistokes and a SUS value of between about 89 and about 325, a smoke point of between about 330 ° F. and about 430.F, a flash point of between about 437 F and about 514° F., and a volatility at about 200° C. after 30 minutes providing a residual weight of between about 45 and about 92 percent.

10. A finish composition as in claim 1 having a pH of between about 5.3 and about 7.2 when diluted with water to provide an aqueous emulsion containing from about 3 to about 20 weight percent of active ingredients.

11. A finish composition as in claim 1 diluted with water to provide an aqueous emulsion containing from about 3 to about 20 weight percent of active ingredients.

12. The process of treating a fiber or textile material with a finish composition, comprising contacting said fiber or textile material with a finish composition comprising from about 5 to about 20 weight percent of an antisatic agent, from about 25 to about 50 weight percent of an emulsifier, and the balance, a synthetic hydrocarbon oil comprising aliphatic polyalphaolefin obtained from the oligomerization of decene-1, based on the weight of said composition.

13. The process as in claim 12 wherein said fiber or textile material is selected from polypropylene and a polyester.

14. The process as in claim 12 wherein said antistatic agent comprises an alkali metel salt of a phosphate ester.

15. The process as in claim 12 wherein said antistatic agent comprises an ethoxylated quaternary amine.

16. The process as in claim 12 wherein said emulsifier is selected from the group consisting of an ester, ethoxylatd ester, ethoxylated fatty acid, and ethoxylated alcohol.

17. The process as in claim 12 wherein said polyalphaolefin contains dimers, trimers and tetramers of decene-1.

18. The process as in claim 17 wherein said polyalphaolefin has a viscosity of about 100° F. of from about 18 to about 70 centistokes and a SUS value of between about 89 and about 325, a smoke point of between about 330° F. and about 430 ° F., a flash point of between about 437° F. and about 514° F., and a volatility at about 200° C. after 30 minutes providing a residual weight of between about 45 and about 92 percent.

19. The process as in claim 12 including diluting said finish composition with water to provide an aqueous emulsion containing from about 3 to about 20 weight percent of active ingredients and a pH of from about 5.3 and about 7.2.

* * * * *